US006132061A

United States Patent [19]

Andrus et al.

[11] Patent Number: 6,132,061

[45] Date of Patent: Oct. 17, 2000

[54] HALOGEN LIGHT FIXTURE

[75] Inventors: Don Andrus, High Point; Brian L. Spitler, Elon College, both of N.C.; Pei Sheng Qian, Shanghai, China

[73] Assignee: Regent Lighting Corporation, Burlington, N.C.

[21] Appl. No.: 09/177,281

[22] Filed: Oct. 22, 1998

Related U.S. Application Data

[60] Provisional application No. 60/086,663, Mar. 26, 1998.

[51] Int. Cl.[7] ..... F21V 18/00

[52] U.S. Cl. ..... 362/217; 362/218; 362/222; 362/223; 362/224; 362/225

[58] Field of Search ..... 362/217, 218, 362/222, 223, 224, 225

[56] References Cited

U.S. PATENT DOCUMENTS 5,154,507 10/1992 Collins ..... 362/218
5,624,178 4/1997 Lee, Jr. ..... 362/220
5,676,458 10/1997 Shemitz et al. ..... 362/374

OTHER PUBLICATIONS

Brochure Entitled: Model 29001 Shop Light Installation Instructions.

*Primary Examiner*—Mohammad Y. Sikder
*Attorney, Agent, or Firm*—Niro, Scavane, Haller & Niro

[57] ABSTRACT

A halogen light fixture that houses at least one halogen lamp and is mountable to a support surface. The fixture includes an elongated housing having opposing ends and an interior space in which the halogen light source located. The fixture is mounted to a surface by mounts that secure the fixture to the support surface. The mounts are also opposingly located on the housing and are adapted to releasably engage a plurality of locations on a surface of the housing which causes the housing to tilt is a predetermined manner thereby allowing light to be directionally positioned.

4 Claims, 5 Drawing Sheets

HALOGEN LIGHT FIXTURE

This application claims priority to pending Provisional Patent Application Serial No. 60/086,663 which was filed on May 26, 1998.

BACKGROUND OF THE INVENTION

The use of halogen lamps in light fixtures provides many advantages over the use of flourescent and incandescent lamps. Halogen light sources provide, among other benefits, pure white light, instant start-up with no flickering, and are operational at any temperature including sub freezing temperatures.

However, halogen light fixtures typically employ one or more lamps having a wattage that is often 100 watts or greater. This use of high wattage lamps increases the heat generated in and around the fixture. Thus, there is a need for light fixtures that allow and provide for the efficient dissipation of the heat generated by the lamp or lamps contained therein. Not only will the dissipation of heat prevent the fixture itself from becoming dangerously hot, it also assists in protecting the fixture's internal components from heat damage as well.

In addition, because of the high temperatures created by a halogen lamp, the possibility exists that objects located near the lamp may unintentionally combust. Consequently, there is a need for a fixture design that prevents objects or structures such as walls and the like from coming into close contact with the light generated by the fixture in order to reduce the risk of inadvertent combustion.

SUMMARY OF THE INVENTION

The present invention, therefore, is directed to a light fixture that houses halogen lamps, and more particularly, a light fixture that is safer to use than light fixtures currently in use. The invention promotes safer operation of halogen lamps by placing the lamp in a tubular fixture having opposingly located vents that use convective air flow to efficiently dissipate heat from the fixture. Moreover, by placing the halogen source in a central location within the fixture, heat is more efficiently radiated outwardly by the walls of the fixture.

In addition, the weight distribution of the fixture is such that when placed upon a flat surface, the fixture will roll in such a manner to direct light away from the surface so as to prevent combustion. Moreover, the present invention uses outwardly adjacent guards that also prevent the combustion of vertical surfaces that may be in close proximity to the lamp.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DETAILED DESCRIPTION OF THE PREFERRED EMBODIMENTS

Figure 1:
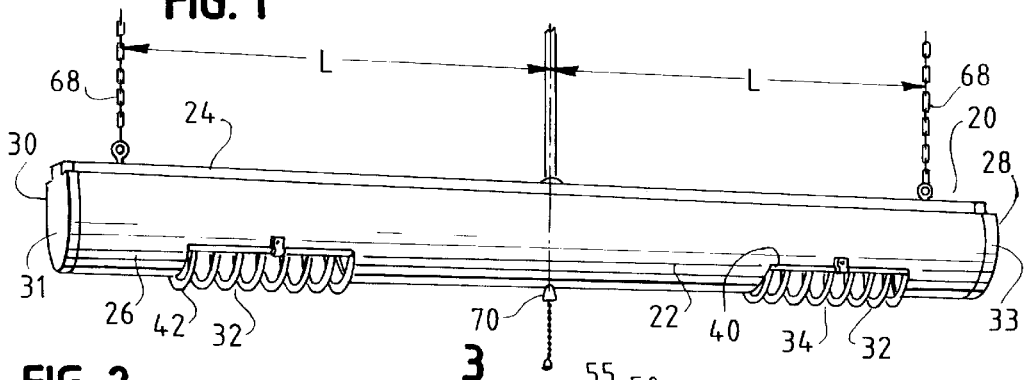
FIG. 1 is a perspective view of one embodiment of the invention.
Figure 2:
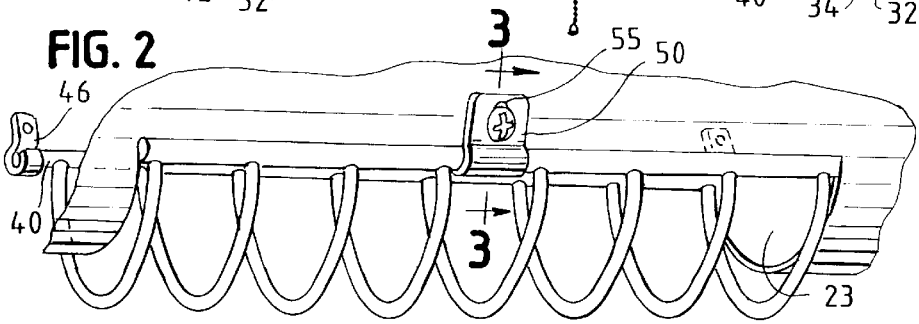
FIG. 2 illustrates the frame in a closed position.

As shown in FIG. 1, the present invention provides a halogen light fixture 20 having an elongated housing 22 including an upper section 24, a lower section 26, and sidewalls 28 and 30 which may be made of stamped metal or some other material known to those of skill in the art. As shown in FIG. 2, housing 22 also defines an interior space 23, which is enclosed by opposingly located ends 31 and 33 which may be made of plastic and affixed to housing 20 by fasteners and the like.

Figure 3:
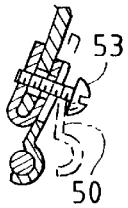
FIG. 3 is a side view of the latch used on the embodiment shown in FIG. 1.
Figure 4:
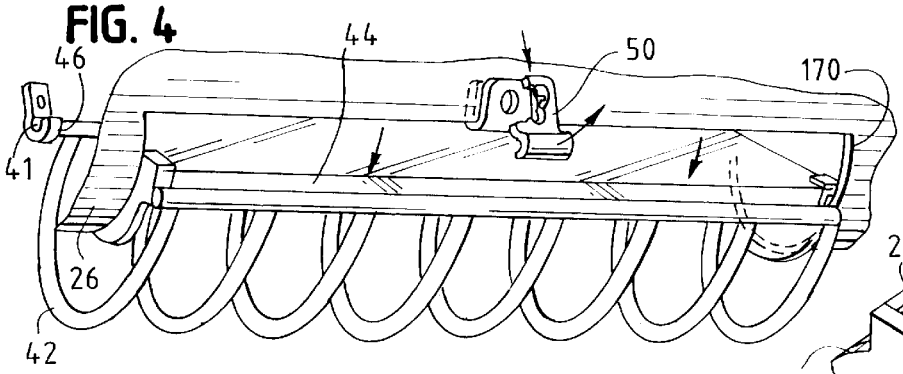
FIG. 4 illustrates the frame in a partially open position.
Figure 5:
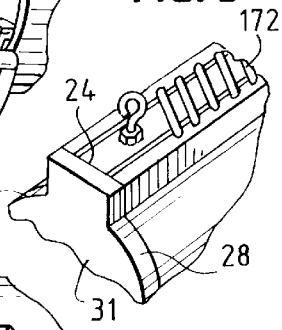
FIG. 5 is a partial perspective view of the upper portion of the embodiment shown in FIG. 1.

Also located on housing 22 are apertures 32 and 34 through which light is transmitted and which are covered by a frame 40 which may include an outwardly extending grill 42 and lens 44. As shown in FIGS. 2–4, frame 40 may be of a welded wire construction or some other suitable construction and pivotally mounted to housing 20 by securing ends 41 of the frame to housing 20 through the use of clips 46. FIG. 3 depicts latch 50 which is also affixed to housing 22 and releasably retains frame 40 in a closed position as shown in FIG. 2, and when disconnected from the frame, frame 40 is an open position as shown in FIG. 6.

The outer edges of frame 40 may be coextensive with lens 44 and lens 44 is secured to frame 40 through the use of clips 51 which are opposingly located on frame 40. Securing lens 44 and grill 42 to frame 40 allows ease of access to lamp 62. As described above, when latch 50 is disengaged and frame 40 is in an open position, both the grill and lens are placed into a position in which they no longer cover aperture 23. This, in turn, allows a user to directly access the lamp without having to remove the grill and lens in separate, time consuming, operations.

To operate latch 50, fastener 53 is loosened and through the use of slot 55, latch 50 is allowed to move away from frame 40. This permits disengagement and the process is reversed when it is desired to place frame 40 in a closed position.

Figure 6:
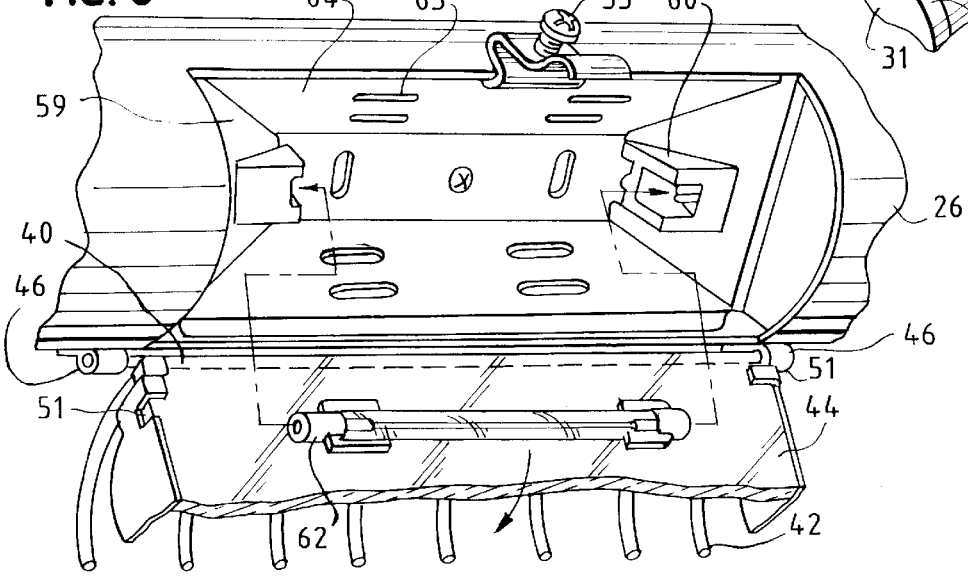
FIG. 6 illustrates the frame in a fully open position.
Figure 7:
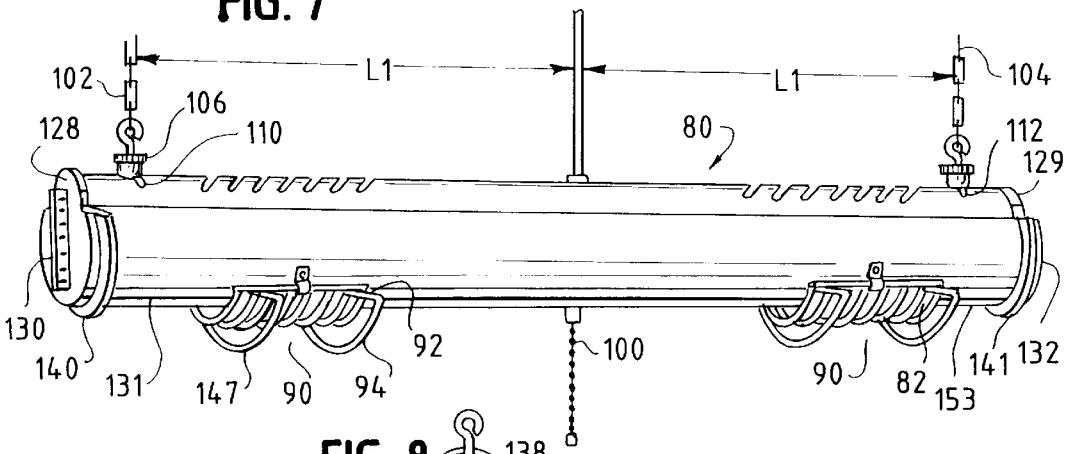
FIG. 7 is a perspective view of another embodiment of the invention.
Figure 8:
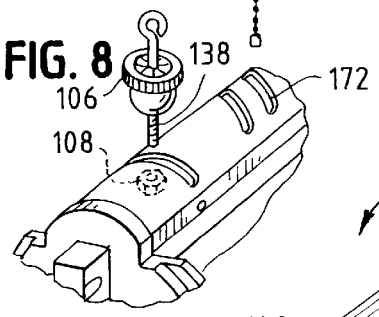
FIG. 8 is a partial perspective view of the upper portion of the embodiment shown in FIG. 7.

As shown in FIG. 6, a light source 59 is aligned with the apertures and located within interior space 23. Light source 59 includes a lamp socket 60 which holds halogen lamp 62 in place and also provides an electrical connection to an electrical source. Also included is reflector 64, having vents 65, which directs light generated by lamp 62 outwardly through the aperture and the lens.

Since halogen light fixtures are generally suspended from a surface such as ceiling, mounts such as chains 66 and 68, as shown in FIG. 1, are provided. To assists users in activating the fixture, a pull switch 70 is also provided. In addition, as shown in FIG. 1, switch 70 may be located in the center of housing 22 and chains 66 and 68 may be located an equal distance from the switch. Configuring the device in this manner balances the device so that when the switch is employed, it reduces, if not eliminates, the sway typically associated with the use of a pull switch on overhead light fixtures.

As shown in FIGS. 7–11, light fixture 80 may be adapted to include an adjustability fixture that permits a user to aim the light in a desired direction. As shown, elongated housing 80 defines an interior space 82 which houses at least one light source 81 comprised of a light socket 84, reflector 86, and halogen lamp 88. As was also described previously, housing 80 includes at least one aperture 90 which is aligned with the light source and which is covered by a frame 92 having affixed thereto a grill 94 and lens 96.

As described above, frame 92 is pivotally connected to housing 80 in the same manner described above through the use of clips 97 and latch 98. As was also described above, a pull switch 100 and chains 102 and 104 are arranged in the same manner described above to prevent the fixture from swaying when the pull switch is used.

Figure 10:
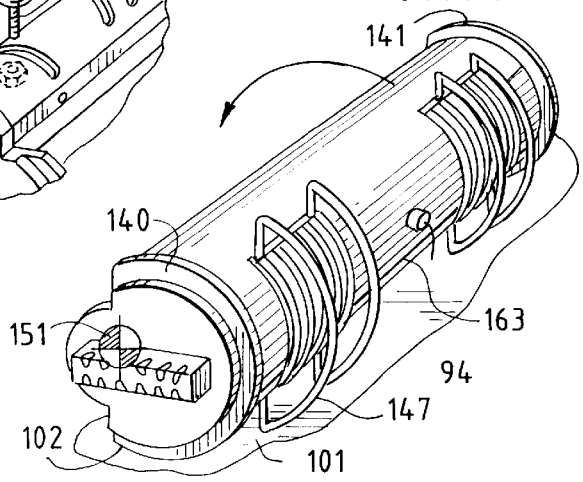
FIG. 10 illustrates how the device rolls over when at rest on a surface.
Figure 11:
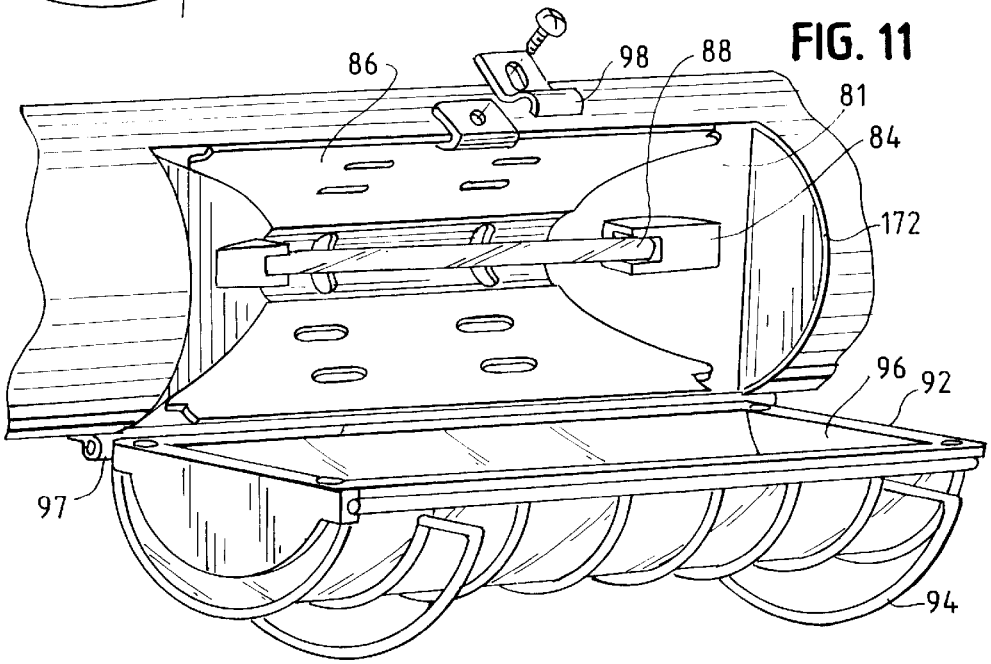
FIG. 11 illustrates the frame in a fully open position.
Figure 15:
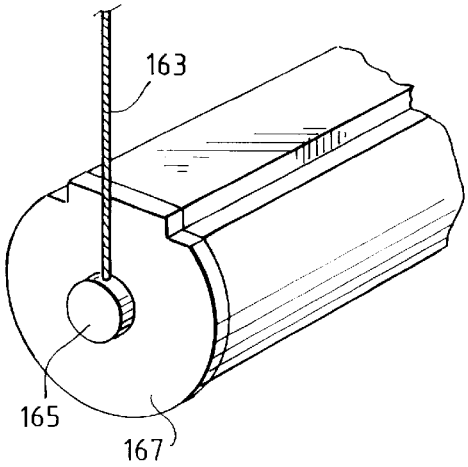
FIG. 15 is a partial perspective view illustrating an adjustment mechanism.
Figure 16:
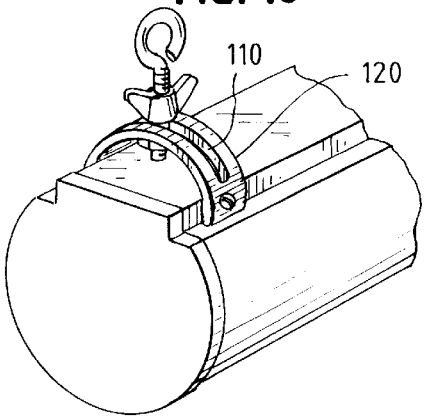
FIG. 16 is a partial perspective view of yet another adjustment mechanism.

To provide an adjustment feature, coacting fasteners 106 and 108 are positioned at one end of chains 102 and 104 and into slots 110 and 112 on surface 120, which may be part of housing 80 or a separate plate which is attached to housing 80 as shown in FIG. 15. As shown in FIG. 10, using coacting fasteners which releasably engage surface 120, allows the chains to located on a plurality positions along housing 80. This, in turn, causes the fixture to tilt and thus adjusts the angle in which light is directed form the fixture. As also shown, in a preferred embodiment, surface 120 may be curved although it need not be so long as the locations in which the mounts engage the housing may be changed.

To adjust the light in a preferred embodiment, the fasteners are first loosened and handles 130 and 132, located on end-caps 128 and 129, are employed to rotate the fixture allowing a shank 138 of fastener 106 to change position on the housing and within the slot located on the curved surface. Once in a desired position, the fasteners are re-tightened to securingly engage the housing.

Figure 9:
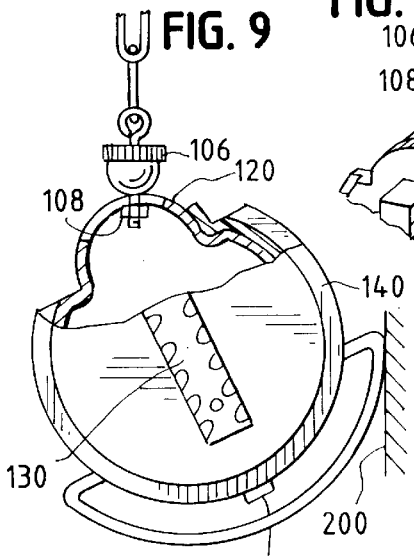
FIG. 9 is a side view of the embodiment shown in FIG. 7.
Figure 12:
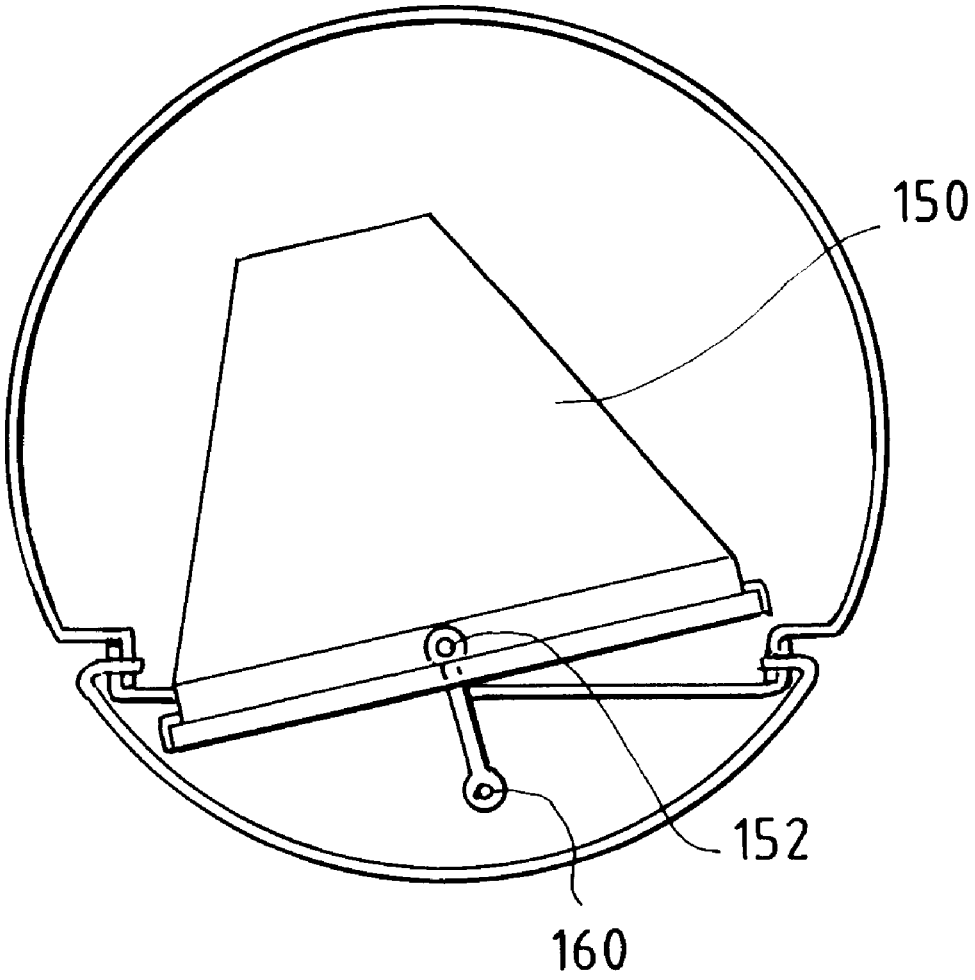
FIG. 12 is a side view of another embodiment of the invention.

Alternatively, as shown in FIG. 12, the light source may be pivotally connected to the housing inside the interior space. As shown, light source 150 is pivotally connected to the housing by opposingly located pins 152 that engage opposite ends of the light source or by other means that form an axis upon which the light source may be pivoted. To assist in positioning the light, a handle 160 may be provided as shown in FIG. 9.

Figure 14:
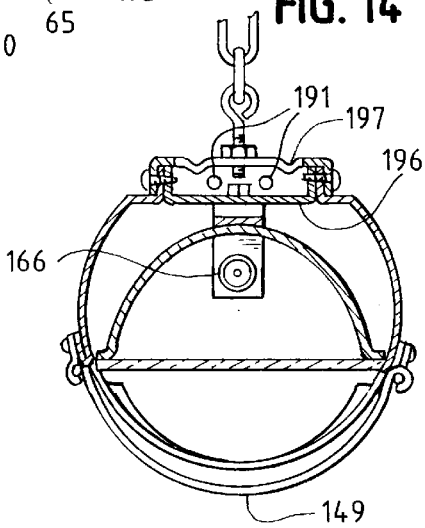
FIG. 14 is a cross sectional view of the embodiment shown in FIG. 13.

As shown in FIGS. 14 and 15, the mount 163 may be pivotally connected to the housing by coacting fasteners 165 and 166 at the end cap 167. Again, arranging the fixture in this manner also allows the fixture to be adjustably positioned.

However, as mentioned above, as a result of the high wattage lamps used in the fixtures of the present invention, there exists the possibility that the light may be adjusted in a manner in which light is directed toward a wall 200 as shown in FIG. 10. In this situation, the heat emitted by the lamp may cause the combustion of the surface. To prevent combustion from occurring, flanges 140 and 141 may be used as guards or projections that hold the fixture away from an object. As shown, flanges 140 and 141 may be located on the end-caps and extend outwardly from housing 80. Flanges 140 and 141 should be sized to extend outwardly a sufficient distance to prevent combustion of the surface, even when the light has been fully positioned inwardly at the object. The flanges may extend outwardly about ¼ to ¾ inches away from the housing.

Alternatively, a grill 145 having one or more sections 147 which extend outwardly beyond the walls of housing may be used. As with the flanges, grill sections 147 should be sized to prevent combustion of the surface even when the light is in its most inwardly directed position. Grill sections 147 may extend about ½ inch to 2 inches past the housing.

Another problem associated with the use of high wattage halogen lamps is that the fixture may come to rest upon a flat surface such as a box or floor while the lamps are activated, a condition which may result in the combustion of the surface. To prevent this from occurring, the fixture is adapted to roll on its side 102 and redirect the light away from the surface.

One manner in which this may be accomplished is to locate the center of mass of the light 151 above the fixture's center line. Locating the weight of the fixture in this manner causes the light to tip or roll over when placed on a flat surface.

Alternatively, a protrusion such as switch 100 may be sized to extend downwardly a sufficient distance to contact the surface to cause the entire fixture to tip over about the protrusion. Alternatively, grill 147 may include points 149 which also cause the fixture to roll as shown in FIG. 14.

Another concern associated with the use of halogen lamps is the efficient dissipation of the heat generated and the cooling of the fixture. As mentioned above, the use of high wattage lamps generates temperatures in excess of those typically associated with flourescent lamps and the like. The high temperatures, if not dissipated, may damage the housing, the internal components of the fixture and, as importantly, present a safety concern.

Figure 17:
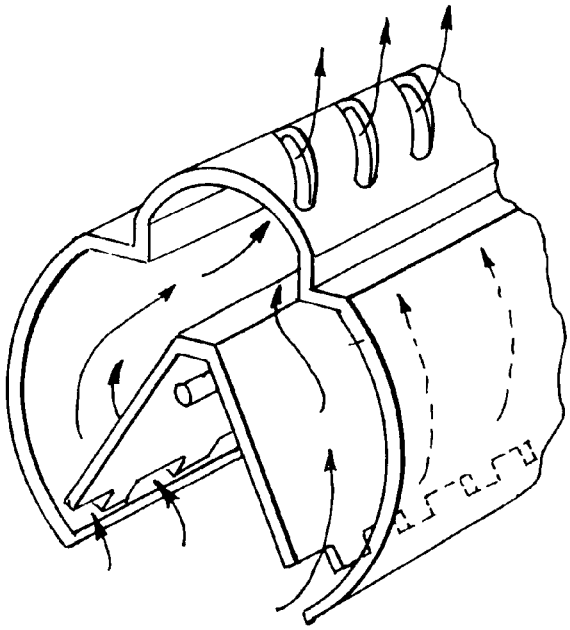
FIG. 17 is a side view which illustrates convective air flow within an embodiment of the invention.
Figure 18:
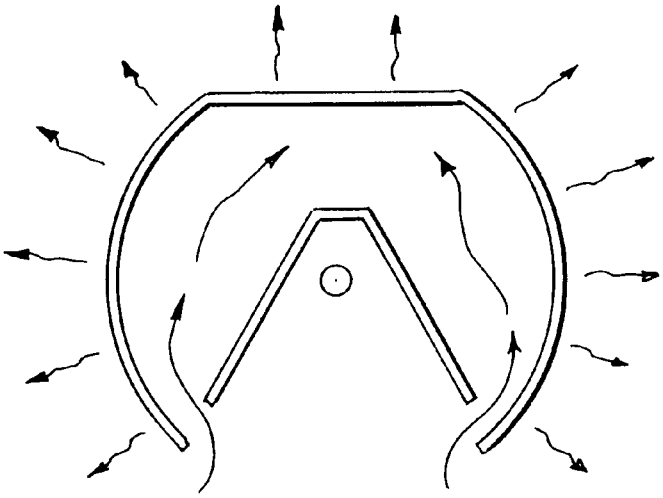
FIG. 18 is another side view which illustrates how heat is evenly dissipated by another embodiment of the present invention.

To efficiently cool the fixture, the light fixture of the present invention uses convection to cool the fixture. As shown in FIG. 17, the present invention provides air intakes 170 which may be gaps between the lens and the housing, and exhaust vents 172 which are opposingly located. In operation, as the air inside interior space is heated, it rises up and is funneled by the sidewalls 180, which taper inwardly, up into and out of the exhaust vents. As the air rises, cool air is drawn into and around the light source 185 by the walls of the fixture.

To optimize the cooling effect of the air flow without creating stagnant or dead air spaces, it has been found that efficient cooling is obtained by having air flow up and around the lamp and then having the sidewalls taper inwardly to funnel the heated air out of the fixture. To further assist in eliminating stagnant or dead air zones that may be created, the sidewalls may terminate co-extensively with or adjacent to the exhaust vents. Arranging the sidewalls in this manner creates air flow paths in which no disruptive countercurrents or eddies are produced which may restrict air flow. Suitable wall configurations include, but are not limited to, curved and/or arcuate walls which produce complimentary air flow paths. As referenced above, walls which taper inwardly are suitable as well.

It has been found that walls of the configuration described above, help eliminate dead air zones or stagnant air pockets in the fixture and it also keeps the air in close proximity to the lamp so as to surround the lamp with cooling air movement, which may not be accomplished with box-like configurations.

Another method by which efficient cooling may be achieved is by locating the lamp substantially in the center of a housing, which may be tubular in construction, in which the lamp is approximately an equal distance from the walls of the housing. Configuring the device in this manner allows the walls of the fixture to be evenly heated and to evenly radiate the energy absorbed. This, too, assists in preventing the device from becoming excessively hot.

Another hazard associated with the use of high temperature halogen lamps is potential damage to the internal wiring due to excessive temperatures. If the wiring is damaged, not only may the device be rendered inoperable, it may also present an electrical hazard. This is of particular concern in the event the wiring comes into contact with the light source.

Figure 13:
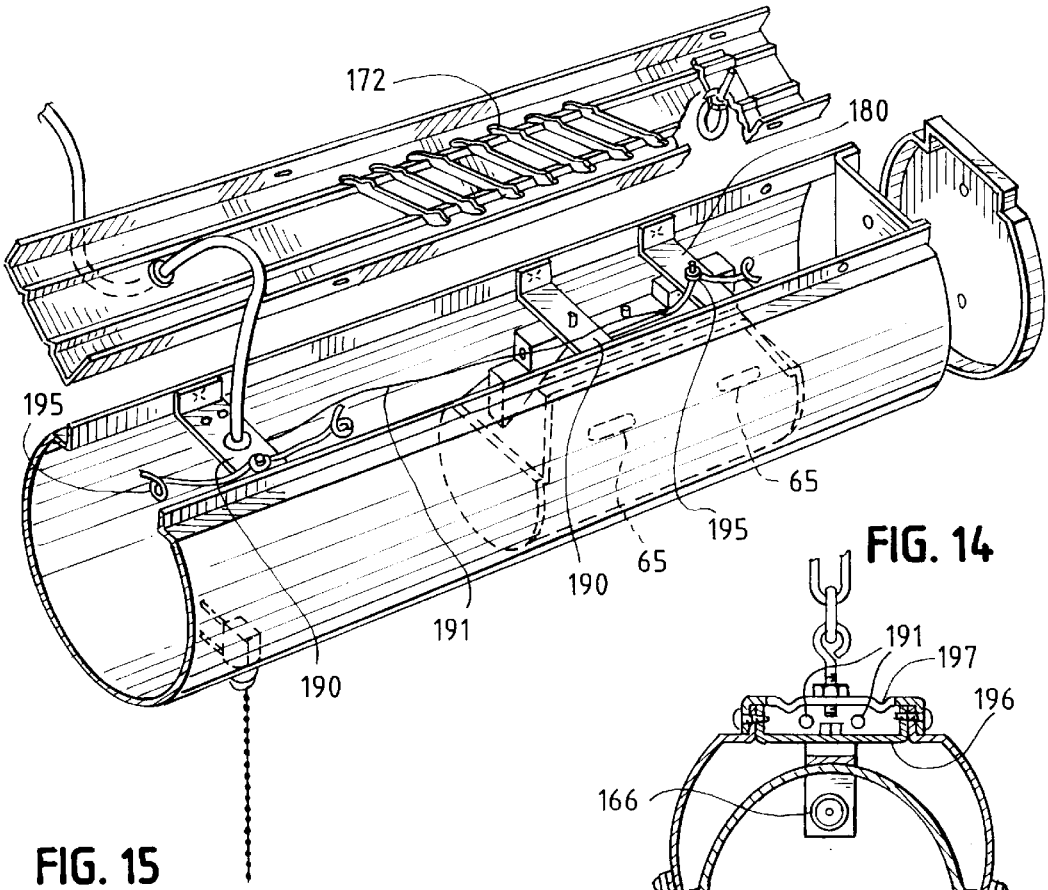
FIG. 13 is a perspective view of another embodiment of the invention.

To prevent this from occurring, the present invention uses one or more wireways 190 which securingly position wiring 191 above the light source. As shown in FIGS. 13 and 14, in a preferred embodiment, wireways 190 are located above the light source and bridge between the sidewalls of the housing. Not only does this provide structure which prevents the wiring from coming into contact with the light source, it shields the wiring as well. Moreover, by bridging between the sidewalls, additional strength is added to the fixture.

Clips 195 may also be used to retain the wiring as well. Lastly, the wireway may be comprised of a first section 196 and second section 197 which form a channel in which the wiring is safely enclosed.

In addition, because vents are used on both the housing and reflector, another hazardous condition may be created when vents 65 and 172 are aligned to permit an electrically conductive device, such as a screwdriver, to be inserted into the device and into contact with the halogen light source. To prevent this from occurring, vents 65 should be aligned in such a manner as to prevent direct access to the light source as shown in FIG. 14. Alternatively, as also shown, wireway 190 may be positioned over vents 65 to act as a shield that prevents access to the halogen light source as well.

It should be understood that various changes and modifications to the preferred embodiment described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A light fixture comprising:

a housing having opposing ends, said housing defining an interior space and upper, lower and side sections and having at least one concave portion upon which said light fixture rolls on a surface;

at least one halogen light source located within said housing;

at least one aperture located on said lower portion of said housing, said aperture in alignment with said light source to allow light to be transmitted outwardly from the housing; and a center of mass defined by at least said light source and said housing, said center of mass is above a center line defined by said housing so that said light fixture rolls upon said concave portion after contacting said surface so as to redirect said transmitted light away from said surface to prevent the combustion of said surface by said outwardly transmitted light.

2. The device of claim 1 further including a protrusion which assists in rolling said light fixture over.

3. The device of claim 1 wherein said concave portion is located on a grill.

4. The device of claim 1 wherein said housing is an elongated tubular housing.

* * * * *